US007052343B2

(12) United States Patent
Ozaki et al.

(10) Patent No.: US 7,052,343 B2
(45) Date of Patent: May 30, 2006

(54) PERSONAL WATERCRAFT

(75) Inventors: Atsufumi Ozaki, Kobe (JP); Keiji Takahashi, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/026,170

(22) Filed: Dec. 29, 2004

(65) Prior Publication Data

US 2005/0170717 A1 Aug. 4, 2005

(30) Foreign Application Priority Data

Jan. 7, 2004 (JP) ..... 2004-001757

(51) Int. Cl.
*B63H 21/38* (2006.01)

(52) U.S. Cl. ..... 440/89 R

(58) Field of Classification Search ..... 440/89 R
See application file for complete search history.

(56) References Cited

U.S. PATENT DOCUMENTS 987,130 A * 3/1911 Geyer ..... 181/235
2,859,830 A * 11/1958 Hoffar ..... 181/246
5,591,058 A * 1/1997 Schriever et al. ..... 440/89 R
6,213,828 B1 4/2001 Tsumiyama et al.

FOREIGN PATENT DOCUMENTS

JP 11-342895 12/1999
JP 11-342896 12/1999

* cited by examiner

*Primary Examiner*—Ed Swinehart
(74) *Attorney, Agent, or Firm*—Alleman Hall McCoy Russell & Tuttle LLP

(57) ABSTRACT

A personal watercraft is disclosed. The personal watercraft typically includes a body formed by a hull and a deck covering the hull from above and having an inner space defined by the hull and the deck, an engine accommodated in the inner space of the body, and an exhaust pipe accommodated in the inner space and configured to guide an exhaust gas emitted from the engine outside the body. The body is typically provided with a penetrating hole through which an inside of the body and an outside of the body communicate with each other. The exhaust pipe is typically configured to extend through the penetrating hole and mounted to the body by a mounting device in the vicinity of the penetrating hole, and the mounting device is removably mounted to the body from outside the body.

4 Claims, 4 Drawing Sheets

PERSONAL WATERCRAFT

BACKGROUND OF THE INVENTION

1. Field of the Invention

The present invention relates to personal watercraft. More particularly, the present invention relates to a mounting structure by which an exhaust pipe that is accommodated in an inner space of a body of the watercraft and that is configured to guide an exhaust gas from an engine outside the body, is mounted to the body.

2. Description of the Related Art

In recent years, water-jet propulsion personal watercraft have been widely used in leisure, sport, rescue activities, and the like. The personal watercraft is configured to accommodate an engine within an inner space of a body formed by joining a hull and a deck covering the hull from above to each other at their peripheries. The engine is configured to drive a water jet pump, which pressurizes and accelerates water sucked from a water intake generally provided on a hull bottom surface and ejects it rearward from an outlet port. As a result, the personal watercraft is propelled.

The personal watercraft is typically equipped with an exhaust system accommodated in the inner space of the body. An exhaust gas emitted from the engine is discharged outside the body through an exhaust outlet formed at a rear portion of the body through the exhaust system. The exhaust system typically includes a muffler capable of reducing a noise level of the exhaust gas. The exhaust port of the muffler and the exhaust outlet formed at the rear portion of the body are typically connected to each other through an exhaust pipe and a rubber pipe.

The exhaust port of the muffler is connected to the exhaust outlet formed at the rear portion of the body in such a manner that a first exhaust pipe extends rearward from the exhaust port of the muffler and a second exhaust pipe extends forward from the exhaust outlet formed at the rear portion of the body. Typically, the first exhaust pipe is welded to the exhaust port of the muffler and the second exhaust pipe is welded or bonded to the exhaust outlet. The first and second exhaust pipes are connected to communicate with each other through a rubber pipe. The rubber pipe is fixed to the first and second exhaust pipes by a clamp or the like. In such a construction, a vibration generated in the muffler and a vibration generated in the body do not substantially affect each other. The exhaust system is typically assembled in the hull before the deck is mounted onto the hull. Another construction to connect the exhaust port of the muffler to the exhaust outlet formed at the rear portion of the body is disclosed in U.S. Pat. No. 6,213,828.

The above described exhaust system is disassembled and taken outside the body for regular maintenance. In the case of a straddle-type personal watercraft equipped with a seat mounted over the deck and configured to be straddled by a rider, an operator disassembles and re-assembles an exhaust system through an opening formed on the deck below the seat. Since the opening is positioned substantially at the center in the longitudinal direction of the body on an upper portion of the deck, it is difficult for the operator to access the muffler located at the rear portion within the body which is relatively distant from the opening to mount and remove the muffler. In particular, since a connecting portion connecting the exhaust port of the muffler to the exhaust outlet formed at the rear portion of the body is very distant from the opening of the deck, the operator has difficulty in disassembling and re-assembling the connecting portion.

Since a number of components such as an engine and an exhaust system are accommodated in a relatively limited inner space of the body, there is little free space within the body. In recent years, in order to reduce a noise level of an exhaust gas more effectively, two mufflers are sometimes mounted within the body of the watercraft and connected to each other through pipes. In such watercraft, there is very little free space within the body, and therefore, it becomes more difficult for the operator to mount and remove the exhaust system to and from the body.

SUMMARY OF THE INVENTION

The present invention addresses the above described conditions, and an object of the present invention is to provide a personal watercraft having a mounting structure of an exhaust system, which allows the exhaust system to be easily removably mounted within a limited inner space of a body of the watercraft.

According to the present invention, there is provided a personal watercraft comprising a body formed by a hull and a deck covering the hull from above and having an inner space defined by the hull and the deck; an engine accommodated in the inner space of the body; and an exhaust pipe accommodated in the inner space and configured to guide an exhaust gas emitted from the engine outside the body, wherein the body is provided with a penetrating hole through which an inside of the body and an outside of the body communicate with each other, the exhaust pipe being configured to extend through the penetrating hole and to be mounted to the body by a mounting device in the vicinity of the penetrating hole, the mounting device being removably mounted to the body from outside the body.

In such a construction, the mounting device by which the exhaust pipe is mounted to the body can be removably mounted from outside the body. By removing the mounting device from outside the body of the personal watercraft, the exhaust pipe accommodated in a rear portion of the body can be easily separated from the body. In addition, by mounting the mounting device to the body from outside the body, the exhaust pipe can be easily mounted to the body. As a result, an exhaust system can be easily removably mounted in the inner space of the body.

The exhaust pipe may have an outer diameter smaller than a diameter of the penetrating hole, and the mounting device may be comprised of a flexible member. In such a construction, a vibration generated in the exhaust pipe and a vibration generated in the body do not substantially affect each other.

The mounting device may be comprised of a seal member configured to seal a clearance formed between the penetrating hole and the exhaust pipe. In such a construction, it is possible to inhibit entry of the water into the inside of the body through the clearance between the penetrating hole of the body and the exhaust pipe.

The exhaust pipe may be configured to have a portion protruding from the penetrating hole outside the body, the mounting device may include a tubular portion through which the exhaust pipe extends and a flange portion extending radially outward from the tubular portion, and the exhaust pipe may be configured to be mounted to the body so as to seal the clearance between the penetrating hole and the exhaust pipe in such a manner that the flange portion of the mounting device is fastened to the body by a bolt from outside the body so as to be tightly fitted to an outer wall of the body, and the tubular portion of the mounting device is clamped to an outer peripheral portion of the protruding portion of the exhaust pipe.

As should be appreciated, the exhaust pipe can be mounted to the body by the mounting device with a relatively simple structure. By mounting the bolt and the clamp from outside the body, the exhaust pipe can be easily mounted to the body. As a result, the exhaust system can be easily removably mounted in the inner space of the body.

A cap may be provided on the outer wall of the body to cover the protruding portion of the exhaust pipe and fastened to the body with the flange portion of the mounting device provided between the body and the cap. Since the cap, which is configured to guide the exhaust gas discharged outside the body, and the seal member are mounted to the body by the same bolt, the mounting structure of the exhaust pipe can be easily disassembled and re-assembled at the rear portion of the body.

The exhaust pipe may be configured to have a portion protruding from the penetrating hole outside the body and to be provided with a male threaded portion on an outer peripheral portion of the protruding portion. The mounting device may include a tubular portion located within the penetrating hole and a flange portion extending radially outward from the tubular portion. The exhaust pipe may extend through an inside of the tubular portion. Further, the exhaust pipe may be configured to be mounted to the body so as to seal a clearance between the penetrating hole and the exhaust pipe in such a manner that the flange portion of the mounting device is fastened to the body by a bolt from outside the body so as to be tightly fitted to an outer wall of the body, and wherein a nut having a female threaded portion that is mountable to the male threaded portion of the exhaust pipe, is fastened to the exhaust pipe.

Thus, the exhaust pipe can be mounted to the body by the mounting device with a relatively simple structure. By mounting the bolt and the nut from outside the body, the exhaust pipe can be easily mounted to the body. As a result, the exhaust system can be easily removably mounted in the inner space of the body.

A cap may be provided on the outer wall portion of the body to cover the protruding portion of the exhaust pipe, and fastened to the body with the flange portion of the mounting device provided between the body and the cap. Since the cap and the mounting device are mounted to the body by the same bolt, the mounting structure of the exhaust pipe can be easily disassembled and re-assembled at the rear portion of the body.

The above and further objects and features of the invention will more fully be apparent from the following detailed description with accompanying drawings.

DETAILED DESCRIPTION OF THE PREFERRED EMBODIMENTS

Figure 1:
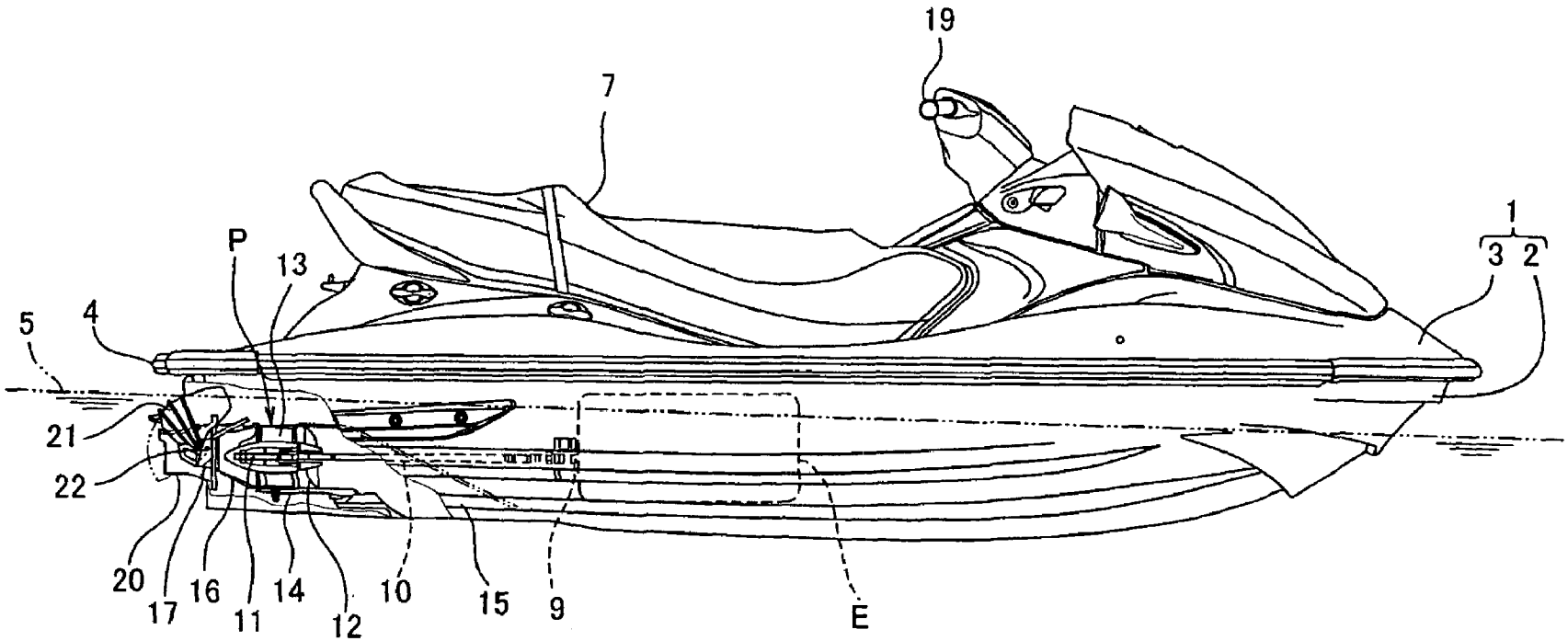
FIG. 1 is a side view of a personal watercraft according to an embodiment of the present invention.

Hereinafter, a personal watercraft according to an embodiment of the present invention will be described with reference to drawings. The personal watercraft in FIG. 1 is a straddle-type personal watercraft equipped with a straddle-type seat 7 configured to be straddled by a rider. A body 1 of the watercraft is formed by a hull 2, and a deck 3 covering the hull 2 from above. A line at which the hull 2 and the deck 3 are connected over the entire perimeter thereof is called a gunnel line 4. The gunnel line 4 is located above a waterline 5 of the personal watercraft being at rest on the water. Herein, directions are described as seen from the perspective of the rider straddling the seat 7, and looking ahead over the bow of the watercraft. The term "longitudinal direction" is used to refer to an orientation extending from bow to stern of the watercraft, while the term "lateral direction" is used to refer to an orientation extending from starboard to port of the watercraft.

Figure 2:
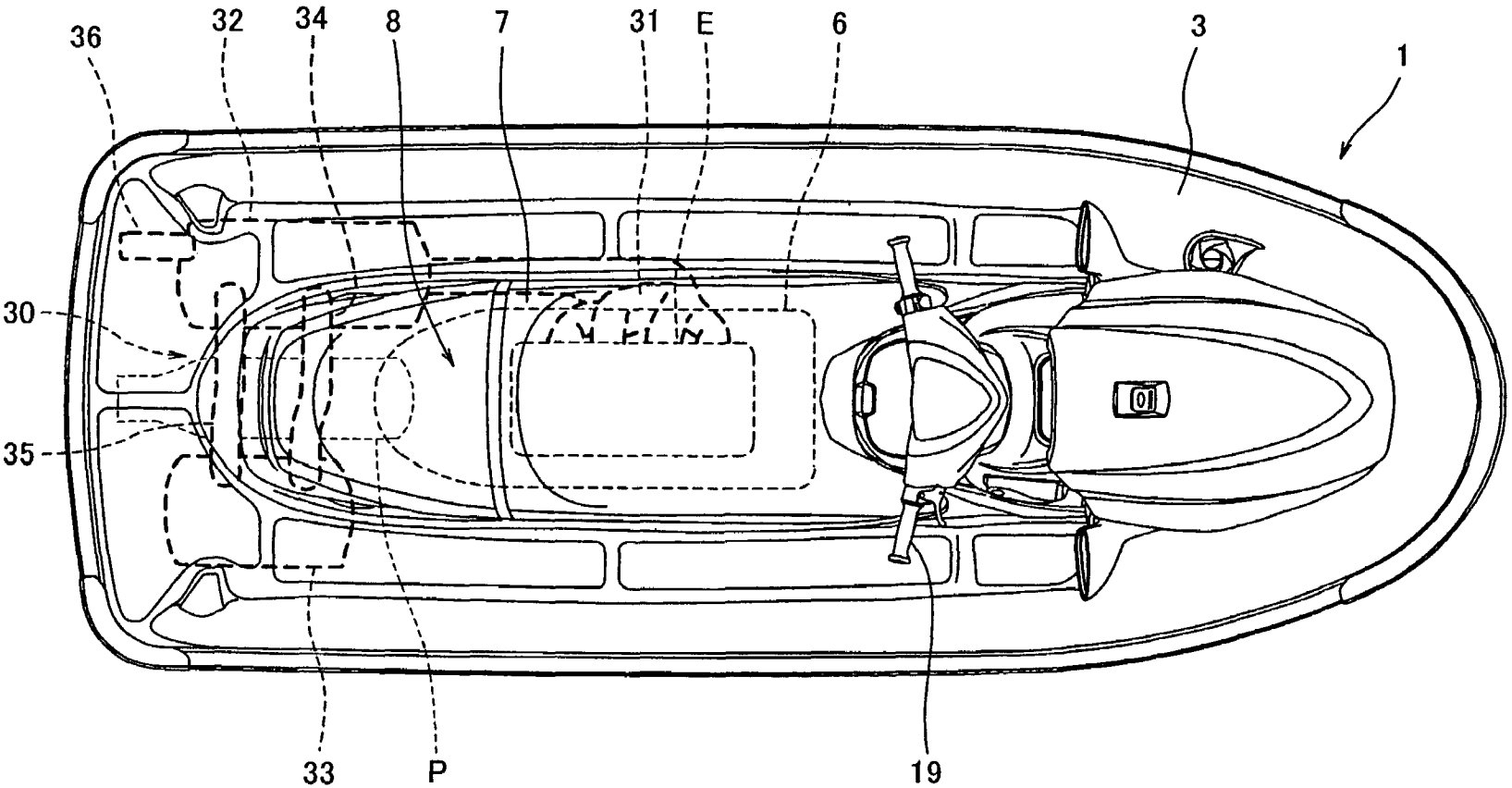
FIG. 2 is a plan view of the personal watercraft in FIG. 1.

As shown in FIG. 2, a deck opening 6, which has a substantially rectangular shape seen from above, is formed on an upper portion of the body 1 at a substantially center section of the deck 3 in the longitudinal and lateral directions of the body 1 to extend in the longitudinal direction of the body 1. The straddle-type seat 7 is removably mounted over the deck opening 6 and configured to be straddled by the rider.

An inner space 8 is defined by the hull 2 and the deck 3 below the deck opening 6. An engine E is accommodated within the inner space 8 and configured to drive the watercraft. The inner space 8 has a convex-shaped transverse cross-section and is configured such that its upper portion is smaller than its lower portion. The engine E is accommodated within the inner space 8 such that a crankshaft 9 extends along the longitudinal direction of the body 1 as shown in FIG. 1.

An output end of the crankshaft 9 is integrally and rotatably coupled with a pump shaft 11 of a water jet pump P disposed at a rear portion of the body 1 through a drive shaft 10. An impeller 12 is attached on the pump shaft 11 of the water jet pump P. Fairing vanes 13 are provided behind the impeller 12. The impeller 12 is covered with a pump casing 14 on the outer periphery thereof.

Figure 3:
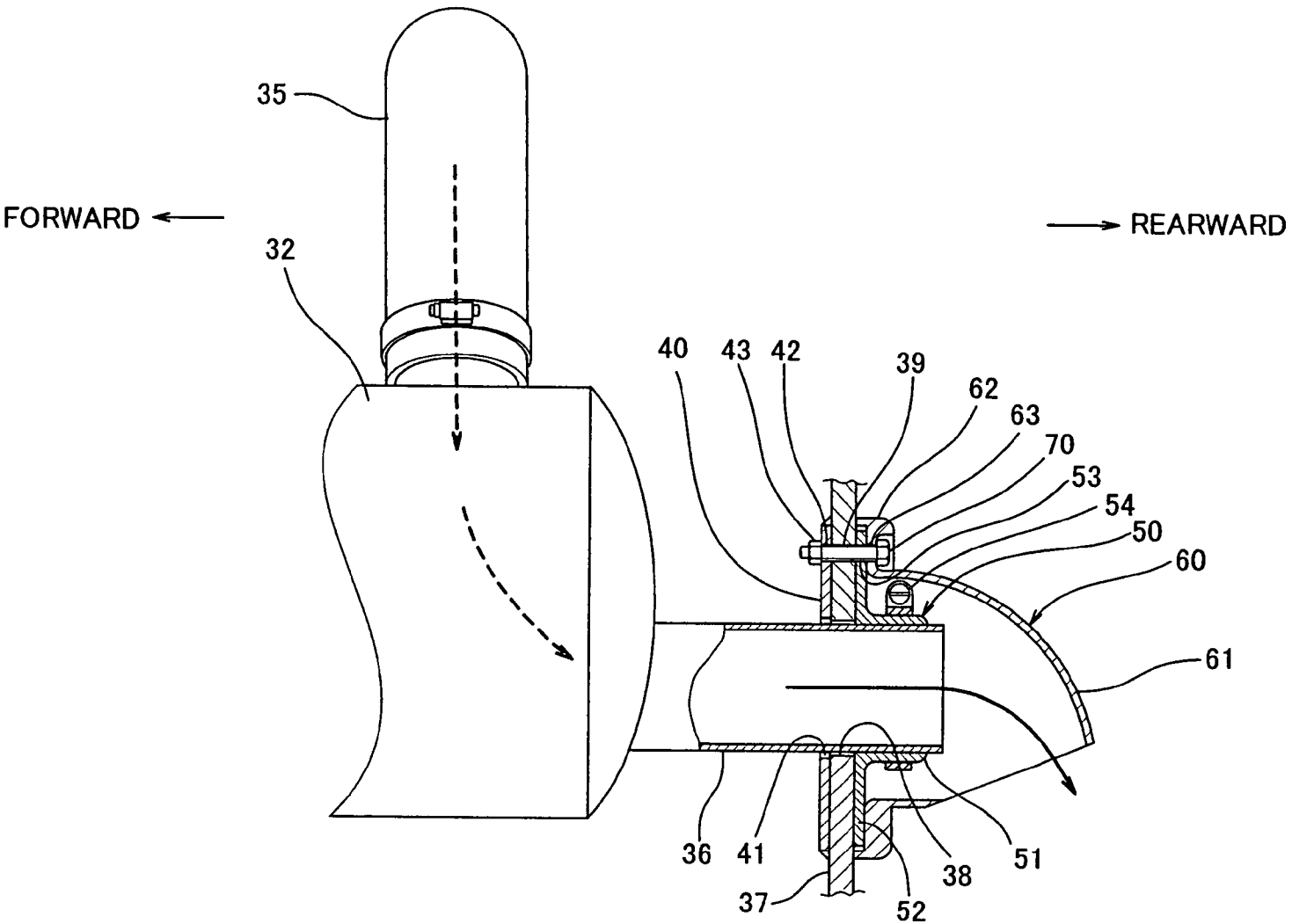
FIG. 3 is an enlarged partial cross-sectional view of a mounting structure by which an exhaust pipe is mounted to a transom board.

A water intake 15 is provided on the bottom of the body 1. The water intake 15 is connected to the pump casing 14 through a water passage. The pump casing 14 is connected to a pump nozzle 16 provided at the rear portion of the body 1. The pump nozzle 16 has a cross-sectional area of flow that is gradually reduced rearward. As shown in FIG. 3, an outlet port 17 is formed at a rear end of the pump nozzle 16.

The water jet pump P pressurizes and accelerates the water sucked from the water intake 15, and the fairing vanes 13 guide the water. The pressurized and accelerated water is discharged rearward through the pump nozzle 16 and from the outlet port 17, and as the resulting reaction, the watercraft obtains a propulsion force.

A bar-type steering handle 19 is attached to a front portion of the deck 3. The steering handle 19 is connected to a steering nozzle 20 disposed behind the pump nozzle 16 through a cable (not shown). By operating the steering handle 19 clockwise or counterclockwise, the steering nozzle 20 is pivoted clockwise or counterclockwise. By operating the steering handle 19, the direction of the water ejected outside through the pump nozzle 16 is changed, and the turning direction of the watercraft is changed, while the water jet pump P is generating the propulsion force.

As shown in FIG. 1, a substantially bowl-shaped reverse bucket 21 is positioned at the rear portion of the body 1 and above the steering nozzle 20. The reverse bucket 21 is vertically pivotable around a pivot shaft 22 that is horizontally oriented. When the reverse bucket 21 is pivoted downward to a lower position around the pivot shaft 22 to be positioned behind the steering nozzle 20, the direction of the water ejected rearward from the steering nozzle 20 is directed substantially forward. As a result, the watercraft is propelled rearward.

As shown in FIG. 2, an exhaust system 30 is equipped in the inner space 8 of the body 1 and configured to guide an exhaust gas from the engine E from the rear portion of the body 1 outside the watercraft. The exhaust system 30 includes an exhaust manifold 31 connected to a left side portion of the engine E, a first water muffler 32 disposed rearward of the exhaust manifold 31 and on the left side of the water jet pump P so as to communicate with the exhaust manifold 31, and a second water muffler 33 disposed on the right side of the water jet pump P. The first and second water mufflers 32 and 33 communicate with each other through a first connecting pipe 34 and a second connecting pipe 35 extending in inverted U-shape over the water jet pump P. Each of the first and second water mufflers 32 and 33 has an inner space separated into a plurality of spaces. An exhaust pipe 36 extends from a rear portion of the first water muffler 32 and penetrates a transom board 37 (FIG. 3) forming a rear wall of the hull 2 to communicate with the outside of the body 1.

In the above described exhaust system 30, the exhaust gas emitted from the engine E is gathered through the exhaust manifold 31 and flows into a space of the first water muffler 32 located rearward of the exhaust manifold 31. Then, the exhaust gas flows from the first water muffler 32 into a space of the second water muffler 33 through the first connecting pipe 34 and then into another space of the first water muffler 32 through the second connecting pipe 35. Further, the exhaust gas is discharged from the first water muffler 32 outside the body 1 through the exhaust pipe 36. It will be appreciated that, since the exhaust gas flows between the first and second water mufflers 32 and 33 having relatively large volumes while expanding and contracting repeatedly, its energy is reduced, and thereby its noise level is lowered.

FIG. 3 is a enlarged partial cross-sectional view showing a mounting structure by which the exhaust pipe 36 is mounted to the transom board 37 at the rear portion of the hull 2. As shown in FIG. 3, the exhaust pipe 36 is formed by a straight pipe. The exhaust pipe 36 has a front end portion welded to a rear end portion of the first water muffler 32, and extends rearward from the welded portion. An inner space of the exhaust pipe 36 and an inner space of the first water muffler 32 communicate with each other.

The transom board 37 is located rearward of the first water muffler 32 and is provided with a penetrating hole 38. A plurality of bolt holes 39, one of which is shown in FIG. 3, are provided in the vicinity of the penetrating hole 38 on the transom board 37. A bracket 40 is bonded to a wall of the transom board 37 on the inner side of the body 1.

The bracket 40 is provided with a center hole 41 conforming to the penetrating hole 38 of the transom board 37 and having a diameter substantially equal to that of the penetrating hole 38, and a plurality of bolt holes 42, one of which is shown in FIG. 3, conforming to the bolt holes 39 of the transom board 37 and having a diameter substantially equal to those of the bolt holes 39. Nuts 43 are welded to a wall of the bracket 40 on the inner side of the body 1 with center axes of the nuts 43 conforming to the center axes of the bolt holes 42. The exhaust pipe 36 extends rearward from the first water muffler 32, through the center hole 41 of the bracket 40, and through the penetrating hole 38 of the transom board 37. A rear end portion of the exhaust pipe 36 protrudes rearward (i.e., outside the body 1) from the transom board 37.

A flexible seal member (mounting device) 50 made of synthetic resin is provided on an outer side of the transom board 37, and the exhaust pipe 36 extends through the seal member 50. The seal member 50 includes a tubular mounting portion 51 to which the exhaust pipe 36 is internally fitted so as to extend through an inside of the mounting portion 51, and a flange portion 52 extending radially outward from a front end portion of the mounting portion 51. The flange portion 52 is provided with a plurality of bolt holes 53, one of which is shown in FIG. 3, conforming to the bolt holes 39 of the transom board 37.

The seal member 50 is provided in such a manner that a front face of the flange portion 52 is in contact with an outer wall (rear wall) of the transom board 37 and the mounting portion 51 is located rearward relative to the flange portion 52. As described later, the flange portion 52 is mounted to the transom board 37 by bolts 70. With the exhaust pipe 36 extending through the mounting portion 51, the mounting portion 51 is externally clamped by a clamp 54. Under this condition, the exhaust pipe 36 is mounted to the transom board 37 in a sealed state by the seal member 50, the clamp 54, and the bolts 70, thereby inhibiting entry of the water from outside to inside of the body 1 through a clearance between an outer peripheral wall of the exhaust pipe 36 and a peripheral portion of the penetrating hole 38.

A cap 60 is mounted on the transom board 37 on the outer side of the body 1 so as to cover the rear end portion of the exhaust pipe 36 and the seal member 50 and configured to guide the exhaust gas from the exhaust pipe 36. The cap 60 includes a guide portion 61 through which the exhaust gas from the exhaust pipe 36 is guided downward, and a flange portion 62 extending radially outward from a front end portion of the guide portion 61. A plurality of bolt holes 63, one of which is shown in FIG. 3, are provided on the flange portion 62 so as to conform to the bolt holes 53 of the flange portion 52 of the seal member 50. The cap 60 is mounted to the transom board 37 along with the seal member 50 by the bolts 70.

Subsequently, a procedure for mounting the exhaust pipe 36 to the transom board 37 with the exhaust pipe mounting structure of FIG. 3, will be described with reference to FIG. 3. First, the exhaust pipe 36 is inserted through the penetrating hole 38 of the transom board 37 and the center hole 41 of the bracket 40 bonded to the transom board 37 from inside the body 1 such that a rear end portion of the exhaust pipe 36 protrudes rearward from the transom board 37. The seal member 50 is externally fitted to the rear end portion of the exhaust pipe 36 with the mounting portion 51 located rearward relative to the flange portion 52. The seal member 50 is disposed so that the center axes of the bolt holes 53 of the flange portion 52 of the seal member 50 and the center axes of the bolt holes 39 of the transom board 37 conform to each other. Under this condition, the mounting portion 51 of the seal member 50 is externally clamped using the clamp 54 to enable the exhaust pipe 36 and the seal member 50 to be tightly sealed.

Then, the cap 60 is disposed to cover the rear end portion of the exhaust pipe 36 and the seal member 50 such that the center axes of the bolt holes 39 of the transom board 37, the center axes of the bolt holes 42 of the bracket 40, the center axes of the bolt holes 53 of the seal member 50, and the center axes of the bolt holes 63 of the cap 60 are caused to conform to one another. The bolts 70 are inserted through these bolt holes from outside the body 1 and screwed into the nuts 43. As a result, the exhaust pipe 36 is mounted to the transom board 37 with the seal member 50 provided between the exhaust pipe 36 and the transom board 37.

In the mounting structure in FIG. 3, the exhaust pipe 36 is mounted to the transom board 37 of the body 1 from outside the body 1, and although there is a predetermined clearance between the outer peripheral wall of the exhaust pipe 36 and the peripheral portion of the penetrating hole 38 of the transom board 37 to permit movement of the exhaust pipe 36 relative to the transom board 37, the clearance between the exhaust pipe 36 and the transom board 37 is sealed to inhibit entry of the water into the inside of the body 1.

When the exhaust pipe 36 is removed from the transom board 37 in the state in FIG. 3, the bolts 70 are removed from outside the body 1 and then the clamp 54 is removed to allow the seal member 50 to be moved rearward to be pulled out from the rear end portion of the exhaust pipe 36. Thus, in the mounting structure shown in FIG. 3, the seal member 50 by which the exhaust pipe 36 is mounted to the transom board 37 can be easily removably fitted to the exhaust pipe 36 from outside the body 1. As a result, the exhaust system 30 can be easily removably mounted in the body 1.

In the mounting structure in FIG. 3, the seal member 50 is easily removably fitted irrespective of the amount of free space within the inner space 8 of the body 1. The mounting structure is especially advantageous to the personal watercraft constructed such that the exhaust pipe 36 is relatively distant from the opening 6 on the upper portion of the deck 3 and various components including the first water muffler 32, the first connecting pipe 34, the second connecting pipe 35, etc., are accommodated in the inner space of the body 1 between the exhaust pipe 36 and the opening 6.

Figure 4:
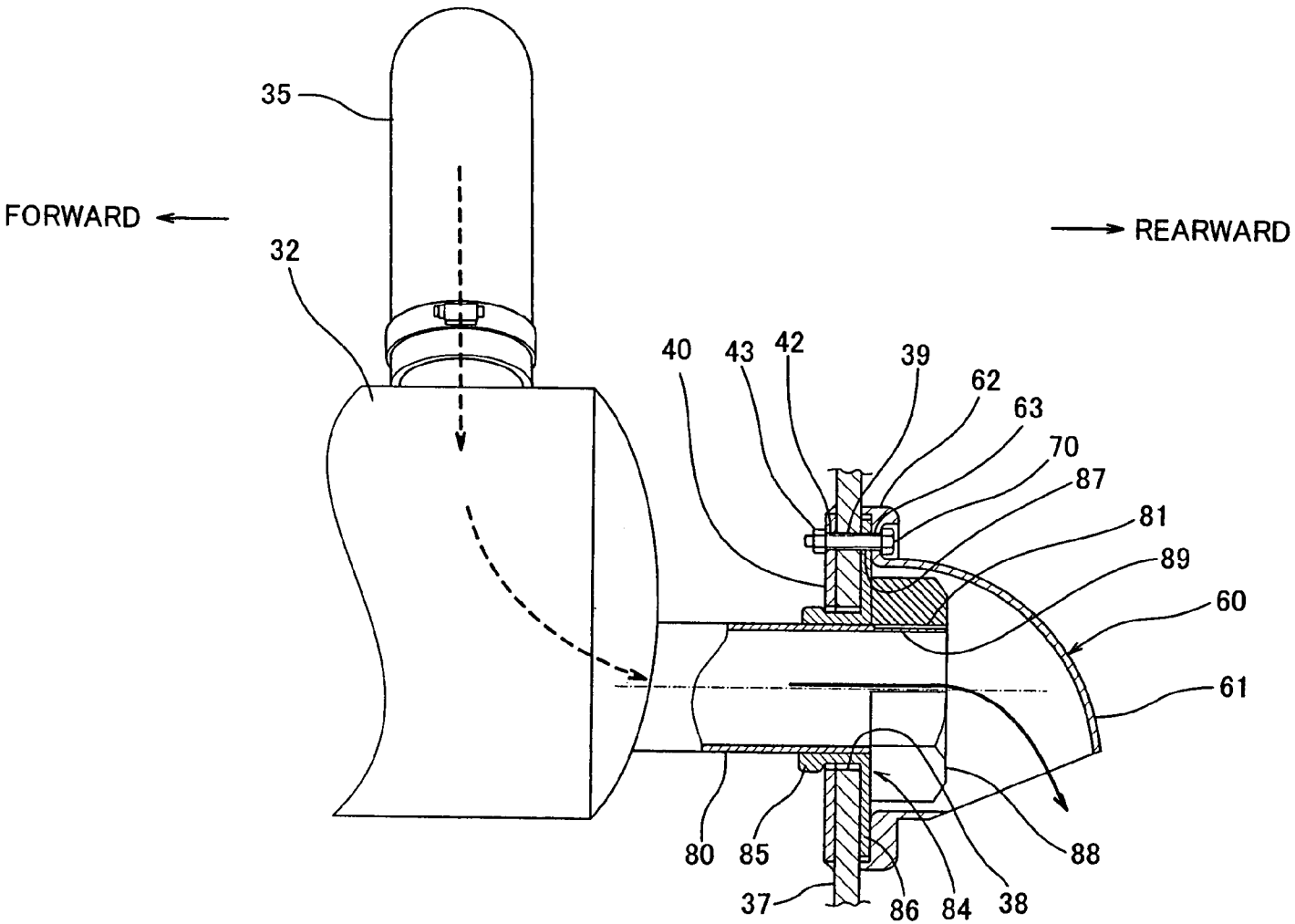
FIG. 4 is an enlarged and partial cross-sectional view of another mounting structure by which the exhaust pipe is mounted to the transom board.

The mounting structure by which the exhaust pipe is removably mounted to the transom board is not intended to be limited to the structure in FIG. 3. FIG. 4 shows another mounting structure by which the exhaust pipe may be removably mounted to the transom board. As shown in FIG. 4, an exhaust pipe 80 has a front end portion welded to a rear portion of the first water muffler 32, and extends rearward from the welded portion through the penetrating hole 38 of the transom board 37 such that a rear end portion protrudes outward and rearward of the body 1 from the transom board 37. A male threaded portion 81 is formed on an outer periphery of a portion of the exhaust pipe 80 which protrudes rearward from the transom board 37.

As in the structure in FIG. 3, the transom board 37 in FIG. 4 is provided with the plurality of bolt holes 39 in the vicinity of the penetrating hole 38, and the bracket 40 having the center hole 41 and the bolt holes 42 is bonded to the wall of the transom board 37 on the inner side of the body 1. The penetrating hole 38 of the transom board 37 conforms to the center hole 41 of the bracket 40 and the bolt holes 39 of the transom board 37 conform to the bolt holes 42 of the bracket 40. The nuts 43 are welded to the wall of the bracket 40 on the inner side of the body 1 with the center axes of the nuts 43 conforming to the center axes of the bolt holes 42.

In the mounting structure of the exhaust pipe 80 in FIG. 4, the exhaust pipe 80 is mounted to the transom board 37 by a mounting device such as a flexible grommet 84 made of synthetic resin, in the vicinity of the penetrating hole 38. The grommet 84 includes a tubular mounting portion 85 to which the exhaust pipe 80 is internally fitted so as to extend through an inside of the mounting portion 85, and a flange portion 86 extending radially outward from a rear end portion of the mounting portion 85. The flange portion 86 is provided with a plurality of bolt holes 87, one of which is shown in FIG. 4, conforming to the bolt holes 39 of the transom board 37.

The grommet 84 is fitted to the exhaust pipe 80 in such a manner that the tubular mounting portion 85 is located within the penetrating hole 38 of the transom board 37 and a front face of the flange portion 86 is in contact with the outer wall (rear wall) of the transom board 37. An outer diameter of the exhaust pipe 80 is substantially equal to or slightly larger than an inner diameter of the mounting portion 85 of the grommet 84. The exhaust pipe 80 is tightly internally fitted to the mounting portion 85 of the grommet 84 so as to extend through an inside of the mounting portion 85. A large-diameter nut 88 has a female threaded portion 89 mountable to a male threaded portion 81 formed at a rear end portion of the exhaust pipe 80 protruding rearward from the grommet 84. The large-diameter nut 88 is fastened to the exhaust pipe 80 from outside the body 1.

The cap 60 is mounted on the transom board 37 on the outer side of the body 1 to entirely cover the rear end portion of the exhaust pipe 80, the large-diameter nut 88, and the grommet 84. The cap 60 is mounted to the transom board 37 along with the grommet 84 by the bolts 70.

A procedure for mounting the exhaust pipe 80 to the transom board 37 in the mounting structure in FIG. 4 will be described with reference to FIG. 4. First, the exhaust pipe 80 is inserted through the penetrating hole 38 of the transom board 37 and the center hole 41 of the bracket 40, which is bonded to the transom board 37, such that a rear end portion of the exhaust pipe 36 protrudes rearward from the transom board 37. The grommet 84 is externally fitted to the rear end of the exhaust pipe 80 with the mounting portion 85 located forward relative to the flange portion 86. The grommet 84 is positioned within the penetrating hole 38 in such a manner that the mounting portion 85 is fitted into a clearance between the penetrating hole 38 of the transom board 37 and the exhaust pipe 80. The grommet 84 is disposed so that the center axes of the bolt holes 87 of the flange portion 86 of the grommet 84 and the center axes of the bolt holes 39 of the transom board 37 conform to each other. Under this condition, the large-diameter nut 88 is fastened to the male threaded portion 81 formed at the rear end portion of the exhaust pipe 80 mounted by the grommet 84.

Thereafter, the cap 60 is disposed to cover the rear end portion of the exhaust pipe 80, the large-diameter nut 88, and the grommet 84 such that the center axes of the bolt holes 39 of the transom board 37, the center axes of the bolt holes 42 of the bracket 40, the center axes of the bolt holes 87 of the grommet 84, and the center axes of the bolt holes 63 of the cap 60 are caused to conform to one another. The bolts 70 are inserted through these holes from outside the body 1 and screwed into the nuts 43. As a result, the exhaust pipe 80 is mounted to the transom board 37 with the grommet 84 provided between the exhaust pipe 80 and the transom board 37.

As should be appreciated, in the mounting structure in FIG. 4, the exhaust pipe 80 is mounted to the transom board 37 from outside the body 1, and the grommet 84 and the large-diameter nut 88 substantially seal a clearance between the exhaust pipe 80 and the transom board 37, thereby inhibiting entry of water into the interior of the body 1. If the large-diameter nut 88 is fastened to the male threaded portion 81 of the exhaust pipe 80 around which a seal tape is wound, a clearance between the male threaded portion 81 and the large-diameter nut 88 can be reliably sealed.

When the exhaust pipe 80 is removed from the transom board 37 in the state shown in FIG. 4, the bolts 70 are removed and then the large-diameter nut 88 is removed from outside the body 1 to allow the grommet 84 to be moved rearward to be pulled out from the rear end portion of the exhaust pipe 80. Thus, in the mounting structure shown in FIG. 4, the grommet 84 by which the exhaust pipe 80 is mounted to the transom board 37 can be easily removably fitted from outside the body 1. As a result, the exhaust system 30 can be easily removably mounted in the body 1.

The present invention is applicable to a stand-up type personal watercraft in which a rider rides on a deck in kneeling or standing position, as well as to the straddle-type personal watercraft equipped with the seat 7.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

a body formed by a hull and a deck covering the hull from above and having an inner space defined by the hull and the deck;

an engine accommodated in the inner space of the body; and an exhaust pipe accommodated in the inner space and configured to guide an exhaust gas emitted from the engine outside the body, wherein the body is provided with a penetrating hole through which an inside of the body and an outside of the body communicate with each other, the exhaust pipe being configured to extend through the penetration hole and to be mounted to the body by a mounting device in the vicinity of the penetrating hole, the mounting device being removably mounted to the body from outside the body.

wherein the exhaust pipe has an outer diameter smaller than a diameter of the penetrating hole, and the mounting device is comprised of a flexible seal member configured to seal a clearance formed between the penetrating hole and the exhaust pipe;

wherein the exhaust pipe is configured to have a portion protruding from the penetrating hole outside the body;

wherein the mounting device includes a tubular portion configured to extend outward from an outer wall of the body, the exhaust pipe extending through the tubular portion, and a flange portion extending radially outward from the tubular portion along the outer wall of the body in the vicinity of the penetrating hole; and wherein the exhaust pipe is configured to be mounted to the body so as to seal the clearance between the penetrating hole and the exhaust pipe in such a manner that the flange portion of the mounting device is fastened to the body by a bolt from outside the body so as to be tightly fitted to the outer wall of the body, and the tubular portion of the mounting device is fastened to an outer peripheral portion of the protruding portion of the exhaust pipe by a clamping member with a clamping force applied radially inward.

2. The personal watercraft according to claim 1, wherein a cap is provided on the outer wall of the body to cover the protruding portion of the exhaust pipe, and is fastened to the body with the flange portion of the mounting device provided between the body and the cap.

3. A personal watercraft comprising:

a body formed by a hull and a deck covering the hull from above and having an inner space defined by the hull and the deck;

an engine accommodated in the inner space of the body; and an exhaust pipe accommodated in the inner space and configured to guide an exhaust gas emitted from the engine outside the body, wherein the body is provided with a penetrating hole through which an inside of the body and an outside of the body communicate with each other, the exhaust pipe being configured to extend through the penetrating hole and to be mounted to the body by a mounting device in the vicinity of the penetrating hole, the mounting device being removably mounted to the body from outside the body.

wherein the exhaust nine has an outer diameter smaller than a diameter of the penetrating hole, and the mounting device is comprised of a flexible seal member configured to seal a clearance formed between the penetrating hole and the exhaust pipe;

wherein the exhaust pipe is configured to have a portion protruding from the penetrating hole outside the body and to be provided with a male threaded portion on an outer peripheral portion of the protruding portion;

wherein the mounting device includes a tubular portion located within the penetrating hole and a flange portion extending radially outward from the tubular portion;

wherein the exhaust pipe extends through an inside of the tubular portion; and wherein the exhaust pipe is configured to be mounted to the body so as to seal a clearance between the penetrating hole and the exhaust pipe in such a manner that the flange portion of the mounting device is fastened to the body by a bolt from outside the body so as to be tightly fitted to an outer wall of the body, and wherein a nut having a female threaded portion mountable to the male threaded portion of the exhaust pipe is fastened to the exhaust pipe.

4. The personal watercraft according to claim 3, wherein a cap is provided on the outer wall portion of the body to cover the protruding portion of the exhaust pipe, and is fastened to the body with the flange portion of the mounting device provided between the body and the cap.

* * * * *